US010633225B2

(12) United States Patent
Hirate et al.

(10) Patent No.: US 10,633,225 B2
(45) Date of Patent: Apr. 28, 2020

(54) CRANE INFORMATION PRESENTATION SYSTEM

(71) Applicant: KOBELCO CONSTRUCTION MACHINERY CO., LTD., Hiroshima (JP)

(72) Inventors: Takayoshi Hirate, Hyogo (JP); Eiji Miya, Hyogo (JP); Keisuke Fukumoto, Hyogo (JP); Toru Nakazawa, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 296 days.

(21) Appl. No.: 15/562,188

(22) PCT Filed: Mar. 30, 2016

(86) PCT No.: PCT/JP2016/060475
§ 371 (c)(1),
(2) Date: Sep. 27, 2017

(87) PCT Pub. No.: WO2016/159128
PCT Pub. Date: Oct. 6, 2016

(65) Prior Publication Data

US 2018/0057319 A1 Mar. 1, 2018

(30) Foreign Application Priority Data

Apr. 1, 2015 (JP) ..... 2015-075029

(51) Int. Cl.
*B66C 13/16* (2006.01)
*B66C 15/00* (2006.01)
(Continued)

(52) U.S. Cl.
CPC ..... *B66C 13/16* (2013.01); *B66C 13/00* (2013.01); *B66C 15/00* (2013.01); *B66C 15/065* (2013.01); *G07C 5/0825* (2013.01)

(58) Field of Classification Search
CPC ..... B66C 13/16
(Continued)

(56) References Cited

U.S. PATENT DOCUMENTS 5,645,181 A * 7/1997 Ichiba ..... B66C 13/46 212/281
6,758,356 B1 * 7/2004 Zuehlke ..... B66C 13/18 212/270
2005/0247657 A1 * 11/2005 Sparenborg ..... B66C 13/16 212/325
2011/0024378 A1 * 2/2011 Pleuss ..... B66C 13/18 212/276
(Continued)

FOREIGN PATENT DOCUMENTS

JP 11-240689 A 9/1999
JP 2004-067379 A 3/2004
(Continued)

OTHER PUBLICATIONS

International Search Report dated Jun. 21, 2016, in PCT/JP2016/060475 filed Mar. 30, 2016.

*Primary Examiner* — Raymond L Nimox
(74) *Attorney, Agent, or Firm* — Oblon, McClelland, Maier & Neustadt, L.L.P.

(57) ABSTRACT

An information presentation system includes: an overload preventing device that derives a load factor which is an index of a load applied to a rope; a data logger that accumulates data on the load factor derived by the overload preventing device and data on a time length for which a load corresponding to the derived load factor has been applied to the rope, the data on the load factor and the data on the time length being associated with one another, and generates lifting rope statistical information and raising rope statistical information indicating a relationship between the load factor and the cumulative time for each rope; and a presenting unit
(Continued)

that presents the lifting rope statistical information and the raising rope statistical information generated by the data logger.

7 Claims, 9 Drawing Sheets

(51) Int. Cl.
*B66C 13/00* (2006.01)
*B66C 15/06* (2006.01)
*G07C 5/08* (2006.01)

(58) Field of Classification Search
USPC ..... 701/34.4
See application file for complete search history.

(56) References Cited

U.S. PATENT DOCUMENTS

2011/0253661 A1* 10/2011 Smith ..... B63B 27/08
212/255
2011/0276261 A1* 11/2011 Mizutani ..... B66C 13/18
701/123
2014/0019016 A1* 1/2014 Miyoshi ..... B66C 13/18
701/50
2014/0027401 A1* 1/2014 Ilaka ..... B66C 13/16
212/276

FOREIGN PATENT DOCUMENTS

JP 2008-127129 A 6/2008
JP 2010-159108 A 7/2017

* cited by examiner

CRANE INFORMATION PRESENTATION SYSTEM

TECHNICAL FIELD

The present invention relates to a crane information presentation system.

BACKGROUND ART

A crane includes a hoisting winch for winching up and winching down a lift-object and a raising winch for raising and lowering a raising member such as a boom. The hoisting winch includes a drum around which a lifting rope which is a wire rope is wound. The hoisting winch causes to rotate the drum to wind up and wind out the lifting rope to winch up or winch down the lift-object. The raising winch includes a drum around which a raising rope, which is a wire rope, is wound. The raising winch causes to rotate the drum to wind up and wind out the raising rope to lift or lower the raising member. There is known a conventional information presentation system that presents information on the wire rope of the winch of the crane (see Patent Literature 1 listed below).

Patent Literature 1 discloses a system that detects the rotation amount of the drum of the hoisting winch of the crane, derives from the detected rotation amount the number of layers and the number of rows of the rope still wound around the drum, and displays the derived numbers of layers and rows of the rope on the display unit.

A load is applied to the wire rope wound out from the winch of the crane during a crane operation. For example, a load caused by a lift-object load is applied to the lifting rope, and a load caused by a forward moment of the raising member is applied to the raising rope. Therefore, fatigue accumulates due to the load applied to the wire rope, and the time comes when the wire rope needs to be replaced.

There has been proposed a system for presenting information on a rope of a winch of a crane, in which the numbers of layers and rows of the rope wound around the drum are displayed on the display unit as described above. However, there is no such system that presents information providing a guideline for determining the timing to replace a wire rope. Generally, it is simply determined that the timing to replace the wire rope has come when the elapsed time since mounting of a wire rope on a winch drum or the total operating time of a crane has reached a specific time period, or it is determined that the timing to replace has come by visually checking the overall condition of the wire rope and the condition of the wires constituting the wire rope.

In such general determining methods however, there is no guideline for determining the timing to replace a wire rope from a view point of fatigue accumulated in the wire rope related to the history of the load applied to the wire rope. Thus, there may be cases where a wire rope is replaced in an earlier timing than necessary, even though the actual accumulated fatigue is not yet so high as to replace the wire rope, which results in an increase in cost.

CITATION LIST

Patent Literature

Patent Literature 1: JP H11-240689 A

SUMMARY OF INVENTION

The present invention has been made to solve the aforementioned problem. An object of the present invention is to present information providing a guideline for determining a timing to replace a wire rope used for a winch of a crane from a view point of fatigue accumulated in the wire rope.

A crane information presentation system according to one aspect of the present invention presents information on a wire rope of a crane including a winch for winding and unwinding the wire rope to lift or lower an object, the system including a load sensor that detects a load applied to the wire rope, a load index deriving unit that derives, based on a load detected by the load sensor, at a predetermined cycle a load index which is an index of a load applied to the wire rope, an information processing device that acquires the load index at the predetermined cycle to generate statistical information indicating a relationship between a cumulative time and the load index, the cumulative time for which a load corresponding to the load index has been applied to the wire rope, and a presenting unit that presents the statistical information generated by the information processing device.

The present invention can present information that provides a guideline for determining the timing to replace a wire rope used for a winch of a crane from a view point of fatigue accumulated in the wire rope.

DESCRIPTION OF EMBODIMENTS

An embodiment of the present invention will now be described with reference to the drawings.

Figure 1:
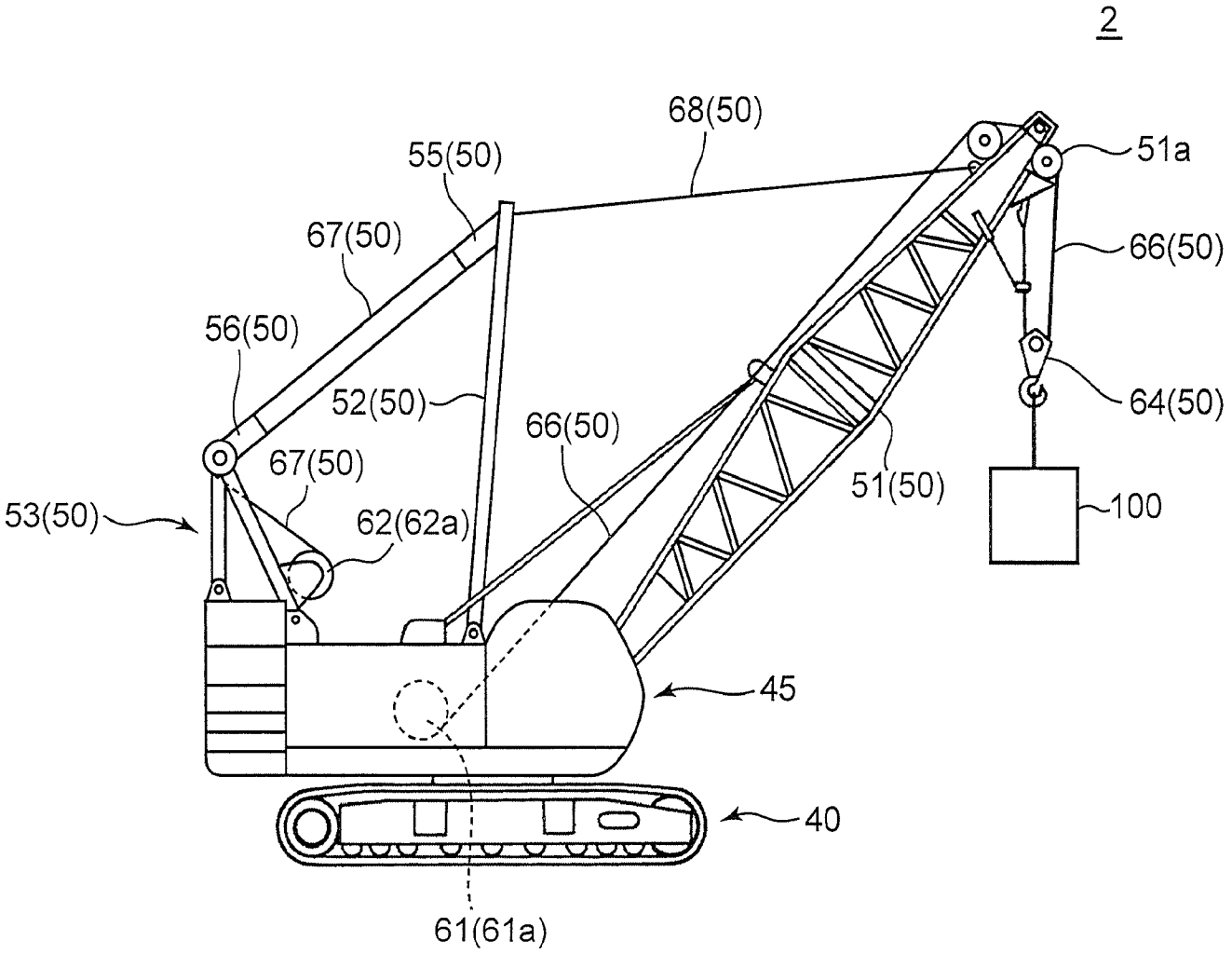
FIG. 1 is a side view of a crane.

With reference to FIG. 1, a crane 2 related to the information presented by an information presentation system 1 according to an embodiment of the present invention, will now be described.

The crane 2 (see FIG. 1) includes a lower travelling body 40 that travels and an upper slewing body 45 that is mounted on the lower travelling body 40 and turns about a vertical axis.

The upper slewing body 45 is provided with a work device 50 that performs crane operations. The work device 50 includes a boom 51 as a raising member, a mast 52, a gantry 53, a mast spreader 55, a gantry spreader 56, a hoisting winch 61, a raising winch 62, a hooking device 64, a lifting rope 66, a raising rope 67, and a guyline 68.

The boom 51 is mounted on the front portion of the upper slewing body 45 to be raised and lowered. A top sheave 51*a* is provided on the distal end of the boom 51.

The mast 52 is provided, behind the boom 51, on the upper slewing body 45. The mast 52 is provided so as to turn about the bottom end of the mast 52. The mast spreader 55 is provided on the top end of the mast 52. The distal end of the mast 52 is connected to the distal end of the boom 51 via the guyline 68.

The gantry 53 is provided upright, in the further rear side of the mast 52, on the upper slewing body 45, namely, on the rear portion of the upper slewing body 45. The gantry spreader 56 is provided on the top end of the gantry 53.

The hoisting winch 61 is an example of the winch of the present invention and mounted on the upper slewing body 45. The hoisting winch 61 includes a hoisting drum 61*a* (an example of the drum) around which the lifting rope 66, which is a wire rope, is wound. The lifting rope 66 wound out from the hoisting drum 61*a* extends to the distal end of the boom 51, and the hooking device 64 is suspended from the distal end of the boom 51. The hooking device 64 is for lifting a lift-object 100. The hooking device 64 includes a hook sheave (not shown). The lifting rope 66 is wound around the hook sheave and the top sheave 51*a* a certain times.

The hoisting winch 61 causes to rotate the hoisting drum 61*a* to wind up and wind out the lifting rope 66, thereby performing winching up and winching down of the hooking device 64 and the lift-object 100 lifted by the hooking device 64.

The raising winch 62 is another example of the winch of the present invention and mounted on the lower portion of the gantry 53. The raising winch 62 includes a raising drum 62*a* (an example of the drum) around which the raising rope 67, which is a wire rope, is wound. The raising rope 67 wound out from the raising drum 62*a* is wound around a sheave of the gantry spreader 56 and a sheave of the mast spreader 55. The raising winch 62 causes to rotate the raising drum 62*a* to wind up the raising rope 67 to pull the mast spreader 55 toward the gantry spreader 56, thereby turning the mast 52 rearward and pulling the distal end of the boom 51 rearward via the guyline 68 to raise up the boom 51. The raising winch 62 causes to rotate the raising drum 62*a* to wind out the raising rope 67 to allow the mast spreader 55 to lean forward away from the gantry spreader 56, thereby turning the mast 52 forward to lower the boom 51.

Figure 2:
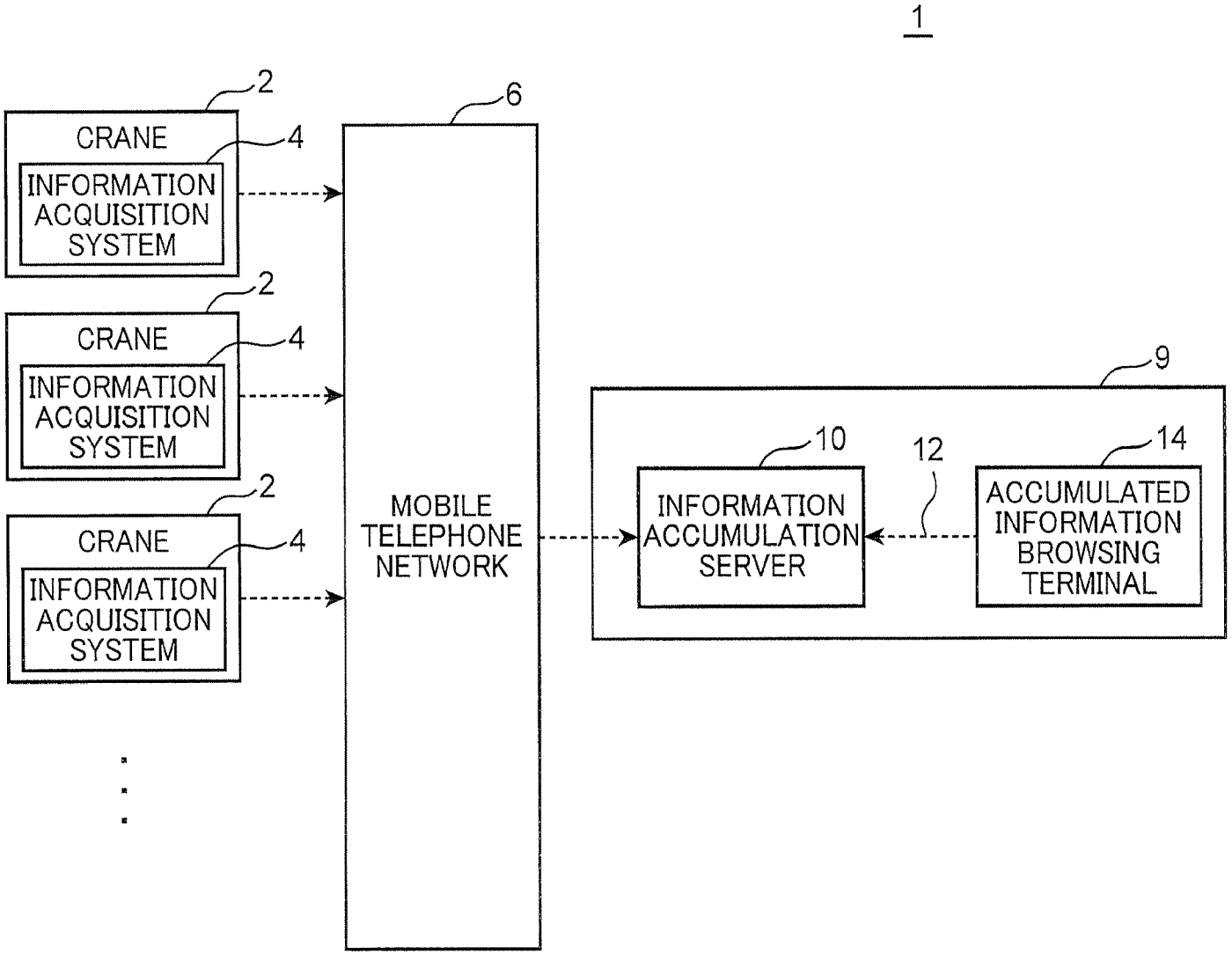
FIG. 2 is a functional block diagram schematically illustrating an overall configuration of an information presentation system according to one embodiment of the present invention.
Figure 3:
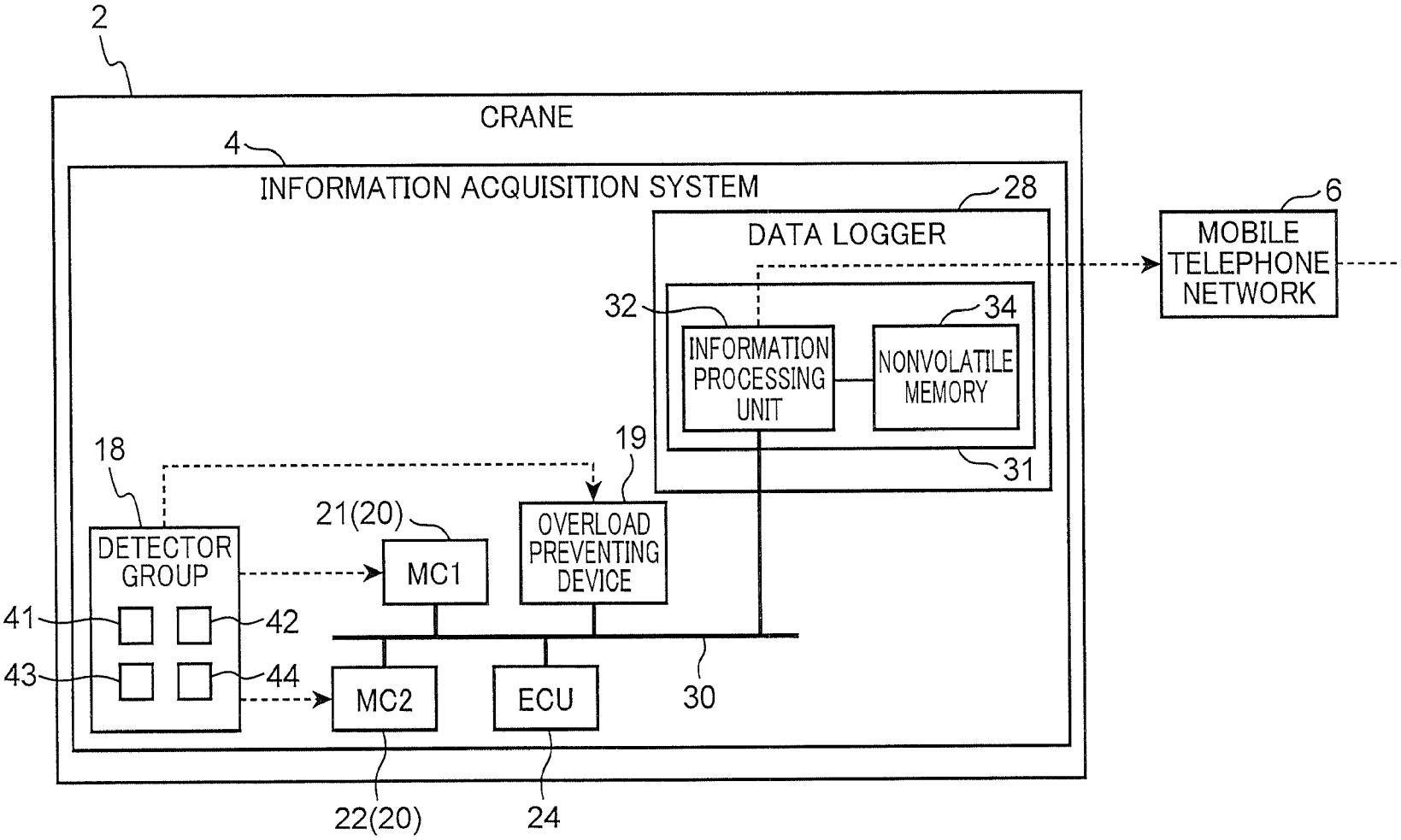
FIG. 3 is a functional block diagram illustrating a configuration of an information acquisition system of a crane constituting the information presentation system.

An information presentation system 1 according to the present embodiment presents information that provides a guideline for determining the timing to replace the lifting rope 66 and the raising rope 67 of the crane 2 as described above. FIG. 2 illustrates a schematic overall configuration of the information presentation system 1. FIG. 3 illustrates a configuration of an information acquisition system 4 of the crane 2 constituting the information presentation system 1.

The information presentation system 1 is configured to acquire and present information on a plurality of cranes 2. As illustrated in FIG. 2, the information presentation system 1 includes the information acquisition system 4 mounted in each of the cranes 2, a mobile telephone network 6, and a presenting unit 9.

The information acquisition system 4 is mounted in the crane 2 to acquire various types of information on the crane 2. As illustrated in FIG. 3, the information acquisition system 4 includes a detector group 18, an overload preventing device 19, a residual wound-amount deriving unit 20, an engine control unit (ECU) 24, a data logger 28, and a control area network bus (CAN-bus) 30.

The detector group 18 includes a plurality of detectors that detect values related to an operation of each operating unit of the crane 2. Specifically, the detector group 18 includes a proximity sensor 41 (an example of a rotation amount sensor) that detects the rotation amount of the hoisting drum 61*a*, a proximity sensor 42 (an example of the rotation amount sensor) that detects the rotation amount of the raising drum 62*a*, a load cell 43 (an example of the load sensor) that detects a load applied to the hoisting drum 61*a*, and a load cell 44 (an example of the load sensor) that detects a load applied to the raising drum 62*a*.

The proximity sensor 41 is provided in the proximity of the hoisting drum 61*a*. A plurality of projections are provided so as to be arranged on the entire circumference of the rim of the axial end face of the hoisting drum 61*a*. The proximity sensor 41 is disposed to face the projections. The proximity sensor 41 detects the projections that pass a location proximate to the proximity sensor 41 as the hoisting drum 61*a* rotates. The proximity sensor 41 outputs pulse signals, the number of which corresponding to the number of the detected projections, as detection signals indicating the rotation amount of the hoisting drum 61*a*.

The proximity sensor 42 is provided in the proximity of the raising drum 62*a* and configured similarly to the proximity sensor 41. That is, a plurality of projections are provided on the raising drum 62*a* similarly to the hoisting drum 61*a*, the proximity sensor 42 detects the projections that pass the location proximate to the proximity sensor 42 as the raising drum 62*a* rotates, and the proximity sensor 42 outputs pulse signals, the number of which corresponding to the number of detected projections, as detection signals indicating the rotation amount of the raising drum 62*a*.

The overload preventing device 19 prevents an overload on the work device 50 during a crane operation. The overload preventing device 19 calculates an actual load applied to the lifting rope 66 based on a value detected by the load cell 43 that detects the load applied to the hoisting drum 61*a*. The overload preventing device 19 also calculates an actual load applied to the raising rope 67 based on a value detected by the load cell 44 that detects the load applied to the raising drum 62*a*. The overload preventing device 19 calculates a load factor of the lifting rope 66 based on the calculated actual load applied to the lifting rope 66, where the load factor is a ratio of the calculated actual load to a rated load of the lifting rope 66. The overload preventing device 19 calculates a load factor of the raising rope 67 based on the calculated actual load applied to the raising rope 67, where the load factor is a ratio of the calculated actual load to a rated load of the raising rope 67. The load factors of the lifting rope 66 and the raising rope 67 are equivalent to indexes of the loads applied to the lifting rope 66 and the raising rope 67, respectively. The load factor is an example of the load index of the present invention. The overload preventing device 19 that calculates the load factor is an example of the load index deriving unit of the present invention.

The overload preventing device 19 determines that an overload has occurred when the calculated load factor of the lifting rope 66 or the calculated load factor of the raising rope 67 has reached 105% or more and stops the operation of the crane 2. When it is determined that an overload has occurred, the overload preventing device 19 stores, in a memory (not shown) in the overload preventing device 19, various types of data including the operating state of the crane 2 at the moment, so that the operating state of the crane 2 at the moment of occurrence of the overload can be recognized later. Specifically, when it is determined that an overload has occurred, the overload preventing device 19 stores, in the memory in the overload preventing device 19, the data at the moment including the date, the time, the raising angle of the boom 51, the rated load, the actual load, the operating radius, the load factor, input and output signals for main controllers 21 and 22 (described later), and manipulation signals from a manipulation lever for manipulating the operating units of the crane 2 such as the hoisting winch 61 and the raising winch 62. When it is determined that an overload has occurred, the overload preventing device 19 transmits to the data logger 28 the same data as the data stored in the memory.

The residual wound-amount deriving unit 20 derives a residual amount of lifting rope 66 wound around the hoisting drum 61*a* of the hoisting winch 61 (hereinafter referred to as a residual wound amount of the lifting rope 66) and a residual amount of the raising rope 67 wound around the raising drum 62*a* of the raising winch 62 (hereinafter referred to as a residual wound amount of the raising rope 67). The residual wound-amount deriving unit 20 is an example of a wound-out length index deriving unit of the present invention. The residual wound amounts of the lifting rope 66 and the raising rope 67 derived by the residual wound-amount deriving unit 20 are examples of the wound-out length indexes of the present invention. The wound-out lengths of the lifting rope 66 and the raising rope 67 from the hoisting winch 61 and the raising winch 62 decrease as the residual wound amounts of the lifting rope 66 and the raising rope 67 increase, and the wound-out lengths of the lifting rope 66 and the raising rope 67 from the hoisting winch 61 and the raising winch 62 increase as the residual wound amounts of the lifting rope 66 and the raising rope 67 decrease. Thus, the residual wound amounts of the lifting rope 66 and the raising rope 67 can be used as the wound-out length indexes, which are indexes of the lengths of the lifting rope 66 and the raising rope 67 wound out from the hoisting winch 61 and the raising winch 62. The residual wound-amount deriving unit 20 includes a first main controller 21 and a second main controller 22.

The first and second main controllers 22 each control the corresponding operating unit of the crane 2. Specifically, the first main controller 21 controls an operation of the hoisting winch 61, and the second main controller 22 controls an operation of the raising winch 62.

The first main controller 21 receives from the proximity sensor 41 pulse signals indicating the rotation amount of the hoisting drum 61*a*. Based on the received pulse signals, the first main controller 21 calculates the residual wound amount of the lifting rope 66 wound around the hoisting drum 61*a* at the moment. That is, the first main controller 21 serves as a device that derives the residual wound amount of the lifting rope 66.

Specifically, the first main controller 21 calculates the rotation amount of the hoisting drum 61*a* from the received pulse signals. Conversion information, which indicates correlation between the rotation amount of the hoisting drum 61*a* and the numbers of layers and rows of the lifting rope 66 wound around the hoisting drum 61*a*, is previously stored in the first main controller 21. The first main controller 21 derives the numbers of layers and rows of the lifting rope 66 corresponding to the calculated rotation amount of the hoisting drum 61*a* based on the conversion information. The first main controller 21 then derives the residual wound amount of the lifting rope 66, namely, the length of the lifting rope 66 still wound around the hoisting drum 61*a* based on the derived numbers of layers and rows of the lifting rope 66.

The second main controller 22 receives pulse signals indicating the rotation amount of the raising drum 62*a* from the proximity sensor 42. Based on the received pulse signals, the second main controller 22 calculates the residual wound amount of the raising rope 67 wound around the raising drum 62*a* at the moment. That is, the second main controller 22 serves as a device that derives the residual wound amount of the raising rope 67.

Specifically, the second main controller 22 calculates the rotation amount of the raising drum 62*a* from the received pulse signals. Conversion information, which indicates correlation between the rotation amount of the raising drum 62*a* and the numbers of layers and rows of the raising rope 67 wound around the raising drum 62*a*, is previously stored in the second main controller 22. The second main controller 22 derives the numbers of layers and rows of the raising rope 67 corresponding to the calculated rotation amount of the raising drum 62*a* based on the conversion information stored in the second main controller 22. The second main controller 22 calculates the residual wound amount of the raising rope 67, namely, the length of the raising rope 67 still wound around the raising drum 62*a* based on the derived numbers of layers and rows of the raising rope 67.

The ECU 24 controls the rotational speed of the engine of the crane 2.

The CAN-bus 30 mutually connects the first and second main controllers 21 and 22, the ECU 24, the overload preventing device 19, and the data logger 28 so as to allow data transfer therebetween. The CAN-bus 30 is hereinafter simply referred to as the bus 30. The first main controller 21 outputs data on the calculated residual wound amount of the lifting rope 66 to the bus 30 at a predetermined cycle. The second main controller 22 outputs data on the calculated residual wound amount of the raising rope 67 to the bus 30 at a predetermined cycle. The overload preventing device 19 outputs data on the rated loads, the actual loads, and the load factors of the lifting rope 66 and the raising rope 67 to the bus 30 at a predetermined cycle.

The data logger 28 is a device that acquires the data flowing in the bus 30 and accumulates the data. The data logger 28 includes an information processing device 31.

The information processing device 31 acquires data on the load factor of the lifting rope 66, data on the load factor of the raising rope 67, data on the residual wound amount of the lifting rope 66, data on the residual wound amount of the raising rope 67, and data related to an operation of the crane 2 (operation-information) from the bus 30 and accumulates the acquired data. In the present embodiment, based on the acquired data, the information processing device 31 generates lifting rope statistical information indicating the relationship among the load factor, the residual wound amount, and the cumulative time of the lifting rope 66 and raising rope statistical information indicating the relationship among the load factor, the residual wound amount, and the cumulative time of the raising rope 67.

The cumulative time included in the lifting rope statistical information corresponds to the elapsed time under which a load corresponding to a certain load factor has been applied to the lifting rope 66 with a certain amount of the lifting rope 66 still wound around the hoisting drum 61*a*. The cumulative time included in the raising rope statistical information corresponds to the elapsed time under which a load corresponding to a certain load factor has been applied to the raising rope 67 with a certain amount of the raising rope 67 still wound around the raising drum 62*a*. The lifting rope statistical information and the raising rope statistical information are examples of load and wound-out-length statistical information of the present invention. The information processing device 31 will now be described in detail.

The information processing device 31 includes an information processing unit 32 and a nonvolatile memory 34. The information processing unit 32 performs processing on the data acquired from the bus 30. The nonvolatile memory 34 stores and accumulates information and data processed by the information processing unit 32.

Specifically, the information processing unit 32 acquires the data on the load factors of the lifting rope 66 and the raising rope 67 from the bus 30 at a predetermined cycle. The information processing unit 32 acquires the data on the residual wound amounts of the lifting rope 66 and the raising rope 67 from the bus 30 at the same predetermined cycle as the predetermined cycle for acquiring the data on the load factors.

The information processing unit 32 counts up time at every acquisition of the data on the load factors and the residual wound amounts of the lifting rope 66 and the raising rope 67. The information processing unit 32 then associates and stores in the nonvolatile memory 34 the acquired data on the load factor of the lifting rope 66, the data on the residual wound amount of the lifting rope 66 acquired at the same timing as the acquisition of the load factor data, and the data on the cumulative time obtained by counting up time at every acquisition of the data. The information processing unit 32 then associates and stores in the nonvolatile memory 34 the acquired data on the load factor of the raising rope 67, the data on the residual wound amount of the raising rope 67 acquired at the same timing as the acquisition of the load factor data, and the data on the cumulative time obtained by counting up time at every acquisition of the data.

Specifically, the information processing unit 32 stores in the nonvolatile memory 34 the data on the cumulative time t in a form of a statistical table in which the load factor and the residual wound amount of the lifting rope 66 are classified into a plurality of categories as shown below, where the categories of the load factor and the categories of the residual wound amount are associated with one another.

TABLE 1

STATISTICAL TABLE

| | | RESIDUAL WOUND AMOUNT OF ROPE y | | | | |
|---|---|---|---|---|---|---|
| | | SECTION 1<br>y ≥ L10 | SECTION 2<br>L9 ≤ y < L10 | SECTION 3<br>L8 ≤ y < L9 | SECTION 4<br>L7 ≤ y < L8 | . . .<br>. . . |
| LOAD FACTOR x | 0% ≤ x < 20% | $t_{11}$ | $t_{21}$ | $t_{31}$ | $t_{41}$ | . . . |
| | 20% ≤ x < 40% | $t_{12}$ | $t_{22}$ | $t_{32}$ | $t_{42}$ | . . . |
| | 40% ≤ x < 60% | $t_{13}$ | $t_{23}$ | $t_{33}$ | $t_{43}$ | . . . |
| | 60% ≤ x < 80% | $t_{14}$ | $t_{24}$ | $t_{34}$ | $t_{44}$ | . . . |
| | 80% ≤ x ≤ 100% | $t_{15}$ | $t_{25}$ | $t_{35}$ | $t_{45}$ | . . . |

In the present embodiment, the load factor x of the lifting rope 66 is classified into a section of 0% or more and below 20%, a section of 20% or more and below 40%, a section of 40% or more and below 60%, a section of 60% or more and below 80%, and a section of 80% or more and 100% or less. A residual wound amount y of the lifting rope 66 is classified into a number of categories each having a predetermined length of the lifting rope 66. The information processing unit 32 specifies the section of the load factor x that includes the data on the acquired load factor of the lifting rope 66 and the section of the residual wound amount y that includes the data on the calculated residual wound amount of the lifting rope 66. The information processing unit 32 records the data on the cumulative time t in a cell, of the statistical table, corresponding to both the specified section of the load factor x and the specified section of the residual wound amount y (the cell at a portion where the row of the specified section of the load factor x and the column of the specified section of the residual wound amount y intersect). The information processing unit 32 accumulates data recorded at every acquisition of data on the load factor and the residual wound amount of the lifting rope 66 to generate the lifting rope statistical information indicating the relationship among the load factor, the residual wound amount, and the cumulative time of the lifting rope 66. The lifting rope statistical information indicates distribution of the cumulative time among the categories of the load factor and the residual wound amount of the lifting rope 66. The concept of cumulative time distribution data of the present invention includes the lifting rope statistical information. The information processing unit 32 stores the generated lifting rope statistical information in the nonvolatile memory 34.

The information processing unit 32 accumulates data of the raising rope 67 similarly to the lifting rope 66, to generate raising rope statistical information indicating the relationship among the load factor, the residual wound amount, and the cumulative time of the raising rope 67. The raising rope statistical information indicates distribution of the cumulative time among the categories of the load factor and the residual wound amount of the raising rope 67. The concept of cumulative time distribution data of the present invention includes the raising rope statistical information. The information processing unit 32 stores the generated raising rope statistical information in the nonvolatile memory 34.

The information processing unit 32 receives data transmitted from the overload preventing device 19 to the data logger 28 upon occurrence of an overload, and stores the data in the nonvolatile memory 34.

The information processing unit 32 transmits the lifting rope statistical information, the raising rope statistical information, the locational information of the crane 2, and the information on the operation of the crane 2 stored in the nonvolatile memory 34 to the information accumulation server 10, which will be described later, of the presenting unit 9 via the mobile telephone network 6 (see FIG. 2). The information processing unit 32 transmits the information as time period data in which the information that has been stored in the nonvolatile memory 34 during a predetermined time period is gathered.

The presenting unit 9 presents the lifting rope statistical information, the raising rope statistical information, and the locational information and operation-information of the crane 2 that are transmitted from the information processing unit 32. That is, the presenting unit 9 presents the time period data transmitted from the information processing unit 32. As illustrated in FIG. 2, the presenting unit 9 includes an information accumulation server 10 and an accumulated information browsing terminal 14.

The information accumulation server 10 receives information from the information processing unit 32 of the data logger 28 in each crane 2 (see FIG. 3), and stores and accumulates the information for each crane 2. The information accumulation server 10 processes the received time period data of the lifting rope statistical information to generate data of a distribution map indicating distribution of the cumulative time among the categories of the load factor and the residual wound amount of the lifting rope 66. The information accumulation server 10 processes the received time period data of the raising rope statistical information to generate data of a distribution map indicating distribution of the cumulative time among the categories of the load factor and the residual wound amount of the raising rope 67. The information accumulation server 10 stores the data of the generated distribution maps for the lifting rope 66 and the raising rope 67.

The information accumulation server 10 is accessible via the Internet 12 through the accumulated information browsing terminal 14. For example, a personal computer is used as the accumulated information browsing terminal 14. The accumulated information browsing terminal 14 is an example of the display unit of the present invention that can display information and data stored in the information accumulation server 10. That is, the information and data stored in the information accumulation server 10 can be browsed using the accumulated information browsing terminal 14.

Figure 4:
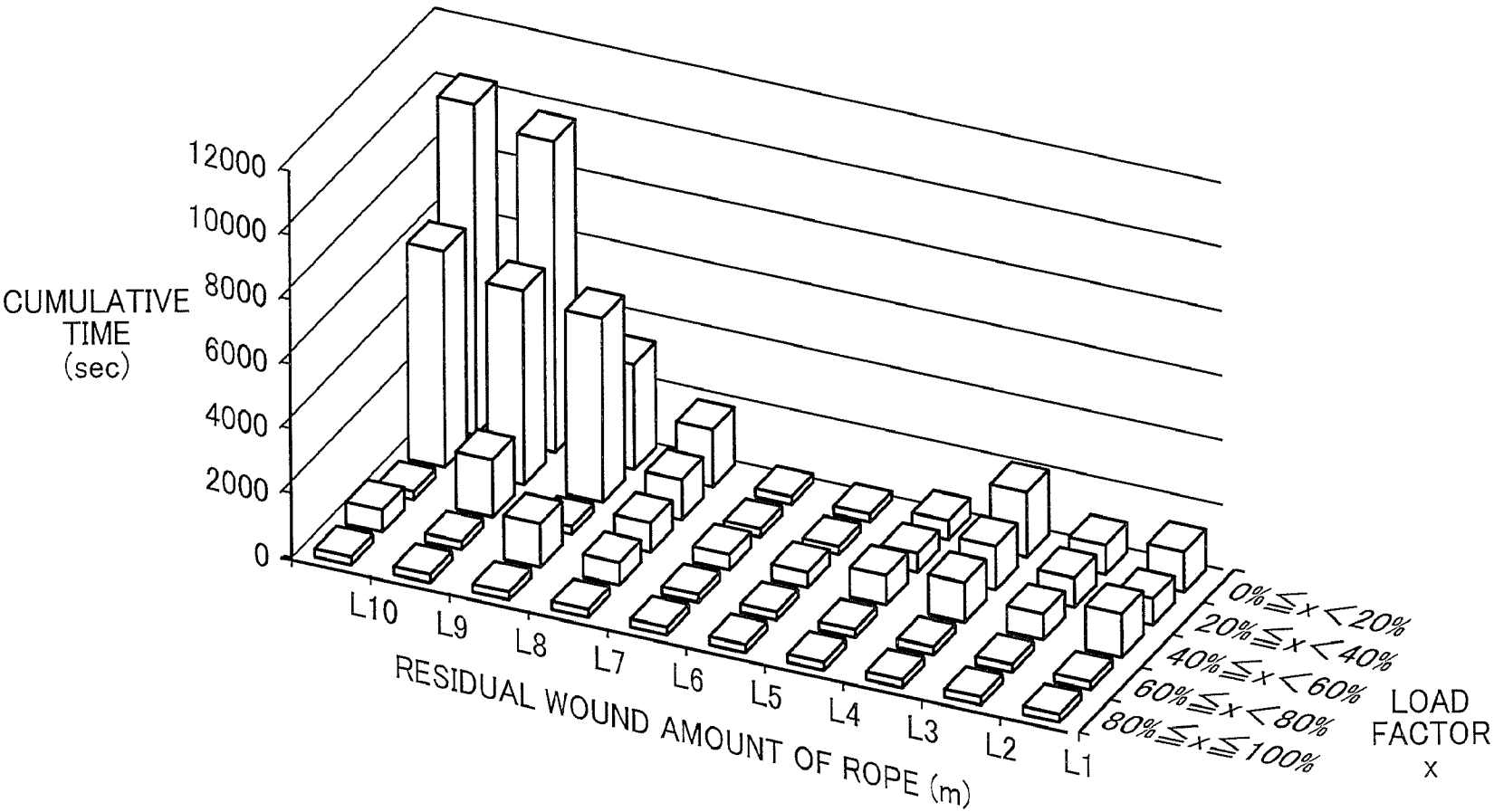
FIG. 4 is a cumulative time distribution map generated from lifting rope statistical information related to crane operations performed with relatively large wound-out lengths of the lifting rope.
Figure 5:
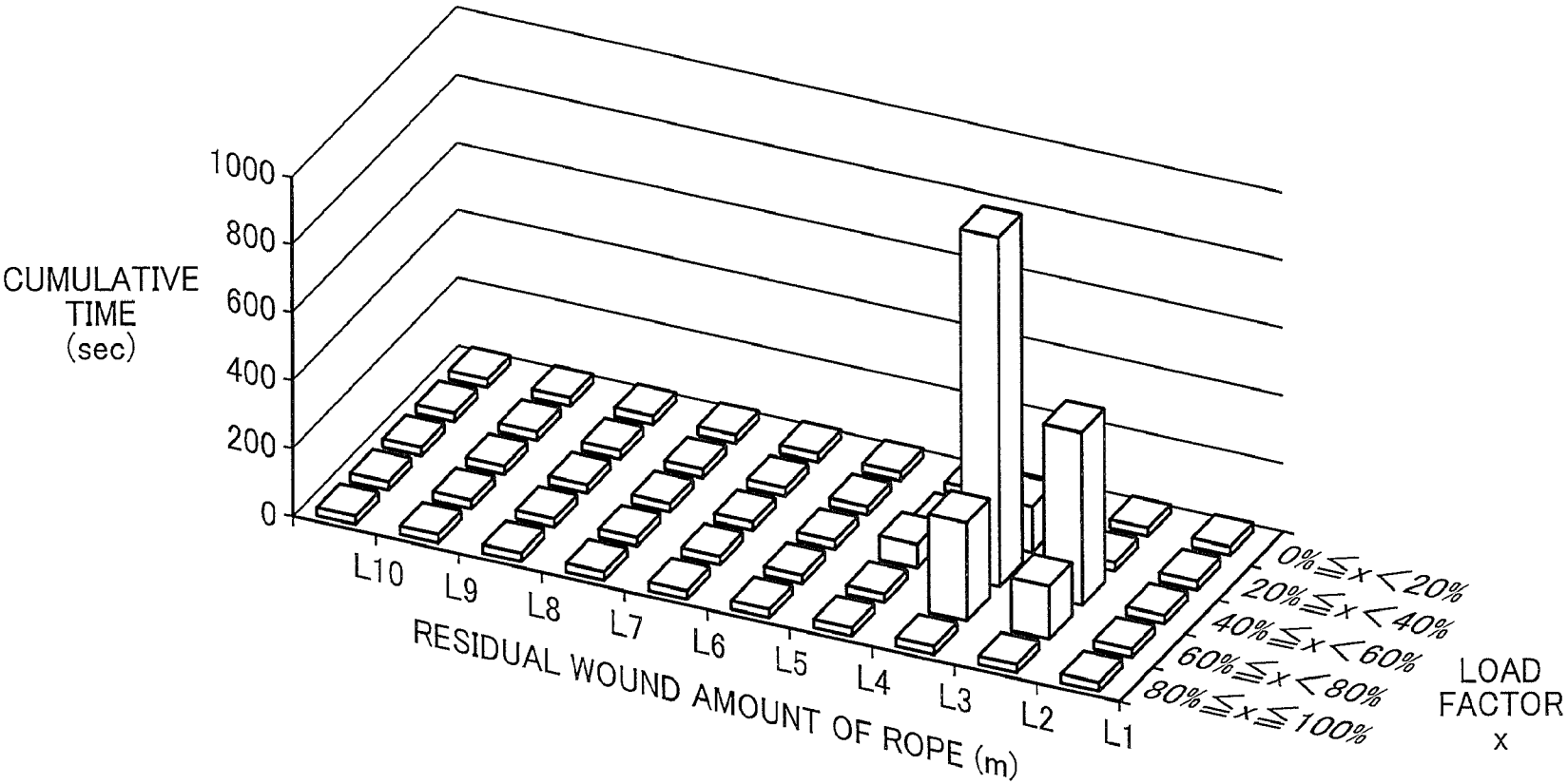
FIG. 5 is a cumulative time distribution map generated from lifting rope statistical information related to crane operations performed with relatively small wound-out lengths of the lifting rope.

FIGS. 4 and 5 illustrate examples of the distribution map for the lifting rope 66 generated from the lifting rope statistical information and displayed on the accumulated information browsing terminal 14. FIG. 4 is a distribution map for crane operations performed with relatively small wound-out lengths of the lifting rope 66, that is, with relatively large residual wound amounts of the lifting rope 66 on the hoisting winch 61. FIG. 5 is a distribution map for crane operations performed with relatively large wound-out lengths of the lifting rope 66, that is, with relatively small residual wound amounts of the lifting rope 66 on the hoisting winch 61. L1 to L10 in FIGS. 4 and 5 indicate the residual wound amount of the lifting rope 66 on the hoisting winch 61. The wound amount of the lifting rope 66 increases as the number appended to "L" increases.

When crane operations are performed with relatively small wound-out lengths of the lifting rope 66, the cumulative time increases in a range where the residual wound amount of the lifting rope 66 is relatively large (in the range from L8 and above) as illustrated in FIG. 4. When crane operations are performed with relatively large wound-out lengths of the lifting rope 66, the cumulative time increases in a range where the residual wound amount of the lifting rope 66 is relatively small (in the range from L2 to L4) as illustrated in FIG. 5. That is, the distribution of the cumulative time among the residual wound amount of the lifting rope 66 depends on whether the crane operations are performed with relatively small wound-out lengths of the lifting rope 66 or relatively large wound-out lengths of the lifting rope 66.

When the cumulative time concentrates in a particular range, and almost does not exist in the other range, of the residual wound amount of the lifting rope 66, that is, when there is a large deviation in the distribution of the cumulative time among the residual wound amount of the lifting rope 66, distribution of used portions of the lifting rope 66 may have a large deviation. When distribution of the used portions of the lifting rope 66 has a large deviation, fatigue may accumulate in particular portions of the lifting rope 66 (the lifting rope 66 may be locally damaged), which may result in the need of earlier replacement of the lifting rope 66. Meanwhile, when the cumulative time is moderately dispersed in the distribution map, it is indicated that used portions of the lifting rope 66 are dispersed and that possibility of fatigue accumulating in particular portions of the lifting rope 66 is small.

Furthermore, when the cumulative time is significantly large in a range where the load factor is large, it is indicated that a large load has been applied to the lifting rope 66 for a long period of time. Also in this case, the lifting rope 66 may be replaced at an earlier timing. Accordingly, the distribution map obtained from the lifting rope statistical information provides a guideline for determining the timing to replace the lifting rope 66.

A distribution map similar to the distribution map obtained from the lifting rope statistical information can be obtained from the raising rope statistical information. The obtained distribution map provides a guideline for determining the timing to replace the raising rope 67.

Figure 6:
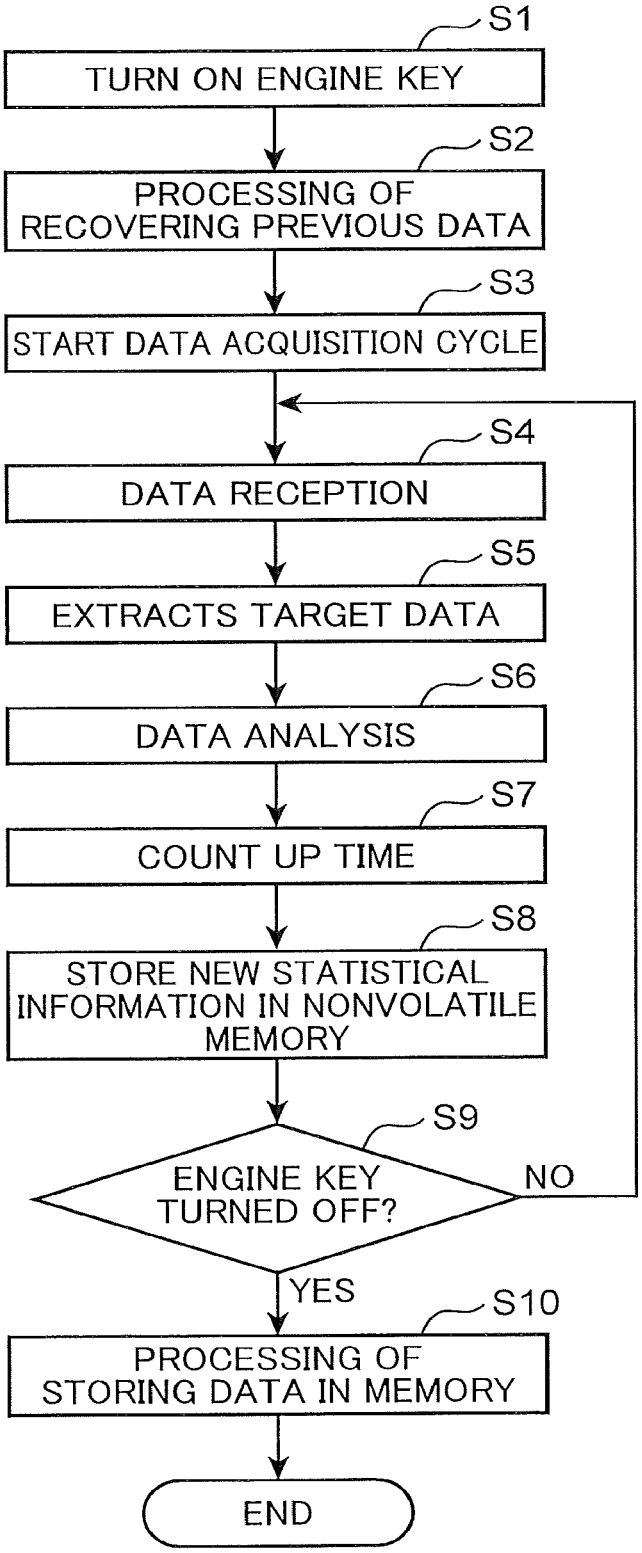
FIG. 6 is a flowchart illustrating a processing step performed in a data logger of the information acquisition system.

Processing performed in the data logger 28 will now be described with reference to the flowchart in FIG. 6.

First, the engine key of the crane 2 is turned on (step S1).

By turning on the engine key, the information processing unit 32 performs processing of recovering previous data in the data logger 28 (step S2). Specifically, various types of data related to a previous operation of the crane 2 has been stored in the nonvolatile memory 34 of the data logger 28 at the timing of completion of the previous operation (at the previous timing of turning off the engine key). By turning on the engine key, the information processing unit 32 reads and recovers the final data previously acquired and stored in the nonvolatile memory 34. More specifically, the information processing unit 32 reads the lifting rope statistical information and the raising rope statistical information from the final data previously acquired and stored in the nonvolatile memory 34 and recovers the lifting rope statistical information and the raising rope statistical information.

The data logger 28 then starts a data acquisition cycle (step S3).

The data logger 28 receives various types of data flowing in the bus 30 (step S4).

The information processing unit 32 extracts target data for generating the lifting rope statistical information and the raising rope statistical information from the data that the data logger 28 has received (step S5). Specifically, the information processing unit 32 extracts the load factor data of the lifting rope 66 and the raising rope 67 and the residual wound amount data of the lifting rope 66 and the raising rope 67 as the target data.

The information processing unit 32 then analyzes the acquired load factor data of the lifting rope 66 and the raising rope 67 and the acquired residual wound amount data of the lifting rope 66 and the raising rope 67 (step S6). Specifically, the information processing unit 32 specifies the section in which the acquired load factor of the lifting rope 66 belongs among the plurality of sections of the load factor in the lifting rope statistical information recovered in step S2, and also specifies the section in which the acquired residual wound amount of the lifting rope 66 belongs among the plurality of sections of the residual wound amount in the lifting rope statistical information. The information processing unit 32 also specifies the section in which the acquired load factor of the raising rope 67 belongs among the plurality of sections of the load factor in the raising rope statistical information recovered in step S2, and also specifies the section in which the acquired residual wound amount of the raising rope 67 belongs among the plurality of sections of the residual wound amount in the raising rope statistical information.

Then, the information processing unit 32 counts up the time in the cell corresponding to both the specified load factor section and the specified residual wound amount section in the lifting rope statistical information by adding the time equivalent to a data acquisition cycle (predetermined cycle: 1 sec) of the information processing unit 32, and counts up the time in the cell corresponding to both the specified load factor section and the specified residual wound amount section in the raising rope statistical information by adding the time equivalent to the data acquisition cycle (step S7).

Then, the lifting rope statistical information and the raising rope statistical information each updated by counting up the time are stored in the nonvolatile memory 34 by the information processing unit 32 (step S8). That is, the information processing unit 32 replaces the lifting rope statistical information and the raising rope statistical information stored in the nonvolatile memory 34 respectively with the lifting rope statistical information updated by counting up the time and the raising rope statistical information updated by counting up the time.

The information processing unit 32 then determines whether the engine key has been turned off (step S9). When it is determined that the engine key has not yet been turned off, the information processing unit 32 repeats the data acquisition cycle in step S4 and the subsequent steps. When it is determined that the engine key has been turned off, the information processing unit 32 performs processing of storing the lifting rope statistical information and the raising rope statistical information, which have been updated in step S8, in the nonvolatile memory 34 (step S10). Then, the processing in the data logger 28 is finished.

Each time when the engine key is turned off, the lifting rope statistical information and the raising rope statistical information in the nonvolatile memory 34 are replaced with the updated lifting rope statistical information and the updated raising rope statistical information stored in step S10. Each time when the engine key is turned off, the information processing unit 32 stores the information on the operation of the crane 2 that has been accumulated in the nonvolatile memory 34 until the timing to turn off the engine key.

In the present embodiment, the information processing unit 32 generates the time period data by gathering the lifting rope statistical information, the raising rope statistical information, and information on the operation of the crane 2 stored in the nonvolatile memory 34 during a predetermined time period, and transmits the generated time period data to the information accumulation server 10 via the mobile telephone network 6.

In the present embodiment, the presenting unit 9 presents the lifting rope statistical information indicating the relationship between the load factor and the residual wound amount of the lifting rope 66 and the cumulative time for which the load corresponding to the load factor has been applied to the lifting rope 66 with the length corresponding to the residual wound amount of the lifting rope 66 still wound around the hoisting drum 61*a*. Meanwhile, the presenting unit 9 presents the raising rope statistical information indicating the relationship between the load factor and the residual wound amount of the raising rope 67 and the cumulative time for which the load corresponding to the load factor has been applied to the raising rope 67 with the length corresponding to the residual wound amount of the raising rope 67 still wound around the raising drum 62*a*.

The lifting rope statistical information indicates what level of load has been applied for what cumulative time to the lifting rope 66 with what length of the lifting rope 66 still wound around the hoisting drum 61*a*, namely, with what length of the lifting rope 66 wound out from the hoisting drum 61*a*. The lifting rope statistical information therefore provides a guideline for determining the timing to replace the lifting rope 66 from a view point of accumulated fatigue. The raising rope statistical information indicates what level of load has been applied for what cumulative time to the raising rope 67 with what length of the raising rope 67 still wound around the raising drum 62*a*, namely, with what length of the raising rope 67 wound out from the raising drum 62*a*. The raising rope statistical information therefore provides a guideline for determining the timing to replace the raising rope 67 from a view point of accumulated fatigue. The present embodiment thus presents information to be a guideline for determining the timing to replace the lifting rope 66 and the raising rope 67 from a view point of accumulated fatigue in the lifting rope 66 and the raising rope 67.

Furthermore, in the present embodiment, the lifting rope statistical information indicates distribution of the cumulative time among the categories of the load factor and the residual wound amount of the lifting rope 66, and the raising rope statistical information indicates distribution of the cumulative time among the categories of the load factor and the residual wound amount of the raising rope 67. That is, the lifting rope statistical information can present the distribution of the cumulative time indicating which condition of what level of load applied to the lifting rope 66 with what length of the lifting rope 66 still wound around the hoisting drum 61*a* has a large cumulative time, and the raising rope statistical information can present the distribution of the cumulative time indicating which condition of what level of load applied to the raising rope 67 with what length of the raising rope 67 still wound around the raising drum 62*a* has a large cumulative time.

Furthermore, in the present embodiment, the information accumulation server 10 generates data of the distribution map indicating distribution of the cumulative time among the categories of the load factor and the residual wound amount of the lifting rope 66 and the raising rope 67 based on the lifting rope statistical information and the raising rope statistical information, and the accumulated information browsing terminal 14 displays the distribution maps of the lifting rope 66 and the raising rope 67 based on the data of the distribution map generated by the information accumulation server 10. Thus, the correlation among the level of loads applied to the lifting rope 66 and the raising rope 67, the residual wound amounts of the lifting rope 66 and the raising rope 67, and the cumulative time can visually be recognized at a glance.

The present embodiment can specify, in a realistic and practical manner without using any additional measuring device, portions of the lifting rope 66 and the raising rope 67 on which loads are applied, and present the lifting rope statistical information and the raising rope statistical information that are not affected by the position of the crane 2 or the like.

Specifically, it is difficult to directly detect portions of the lifting rope 66 and the raising rope 67 on which the loads are applied during a crane operation. Meanwhile, the wound amounts of the lifting rope 66 and the raising rope 67 on the hoisting drum 61*a* of the hoisting winch 61 and the raising drum 62*a* of the raising winch 62 are values usually measured by some kinds of method, and the total lengths of the lifting rope 66 and the raising rope 67 are known values. Thus, the length of portions of the lifting rope 66 and the raising rope 67 wound out from the hoisting drum 61*a* and the raising drum 62*a* can be derived from the residual wound amounts of the lifting rope 66 and the raising rope 67 on the hoisting drum 61*a* and the raising drum 62*a*. Thus, although the very local portions of the lifting rope 66 and the raising rope 67 on which the loads are applied cannot be specified, it is possible to recognize which portions of the lifting rope 66 and the raising rope 67 the loads are applied on, based on the residual wound amount values. The present embodiment derives the residual wound amounts of the lifting rope 66 and the raising rope 67 on the hoisting drum 61*a* and the raising drum 62*a* as wound-out length indexes and thereby specifies, in a realistic and practical manner without using any additional measuring devices, the portions of the lifting rope 66 and the raising rope 67 on which the loads are applied. Since the residual wound amounts of the lifting rope 66 and the raising rope 67 on the hoisting drum 61*a* and the raising drum 62*a* are values that are not affected by the position of the crane 2 or the like, the present embodiment can derive the residual wound amounts as the wound-out length indexes to present the lifting rope statistical information and the raising rope statistical information that are not affected by the position of the crane 2 or the like.

The embodiments disclosed herein are illustrative in all aspects and should not be construed as limiting. The scope of the present invention is defined by the claims, rather than by the description on the embodiment, and all changes within the claims and the meaning and range of equivalents thereof are intended to be embraced therein.

For example, the lifting rope statistical information and the raising rope statistical information may not include the residual wound amount data of the lifting rope 66 and the raising rope 67. That is, the lifting rope statistical information (the raising rope statistical information) may indicate only the relationship between the load factor of the lifting rope 66 (the raising rope 67) and the cumulative time for which the load corresponding to the load factor has been applied to the lifting rope 66 (the raising rope 67).

The information processing unit 32 of the data logger 28 may acquire information on the state of the work device 50 and information on the work position of the crane 2 at the time of stopping the operation of the crane 2, that is, at the time of stopping the engine, store the information in the nonvolatile memory 34, and transmit the stored information to the presenting unit 9. In this case, the presenting unit 9 presents the received information on the state of the work device 50 and the work position of the crane 2 at the time of stopping the operation of the crane 2.

When the crane 2 is not operating, the lifting rope 66 and the raising rope 67 are kept in a static state with loads applied to predetermined portions of the lifting rope 66 and the raising rope 67 wound out from the respective hoisting drum 61*a* and raising drum 62*a*. For example, the load is still applied to portions of the lifting rope 66 very close to the hoisting drum 61*a*, the portion curved along the top sheave 51*a*, and the portion curved along the hook sheave while the lifting rope 66 is kept in a static state. Meanwhile, the load is still applied to portions of the raising rope 67 very close to the raising drum 62*a*, the portion curved along the sheave of the gantry spreader 56, and the portion curved along the sheave of the mast spreader 55 while the raising rope 67 is kept in a static state.

The portions of the lifting rope 66 and the raising rope 67 on which the load is applied while the crane 2 is not operating depends on the state of the work device 50 and the work position of the crane 2, but can roughly be specified by recognizing the state of the work device 50 and the work position of the crane 2. Thus, the information on the state of the work device 50 and the work position of the crane 2 at the time of stopping the operation of the crane 2 presented by the presenting unit 9, as described above, indicates the portions of the lifting rope 66 and the raising rope 67 on which the loads are applied while the crane 2 is not operating.

In the embodiment described above, the information processing unit 32 of the data logger 28 generates the lifting rope statistical information and the raising rope statistical information, and the information accumulation server 10 generates data of the distribution map of the cumulative time of the lifting rope 66 and data of the distribution map of the cumulative time of the raising rope 67 based on the statistical information generated by the information processing unit 32. However, the processing on the information according to the present invention is not limited to such a configuration.

For example, the information processing unit 32 may perform the entire processing of acquiring the data on the load factors and the residual wound amounts of the lifting rope 66 and the raising rope 67, generating the lifting rope statistical information and the raising rope statistical information, and generating the data of distribution maps of the cumulative time of the lifting rope 66 and the raising rope 67. In this case, the information processing unit 32 transmits the data of the generated distribution maps of the cumulative time of the lifting rope 66 and the raising rope 67 to the information accumulation server 10 of the presenting unit 9. The information accumulation server 10 then accumulates and stores the received distribution map data so that the stored distribution map data can be browsed through the accumulated information browsing terminal 14.

In this case, based on the data of the generated distribution map of the cumulative time of the lifting rope 66 and the raising rope 67, the information processing unit 32 may display the distribution map corresponding to the data on a manipulation panel provided in the crane 2.

Figure 7:
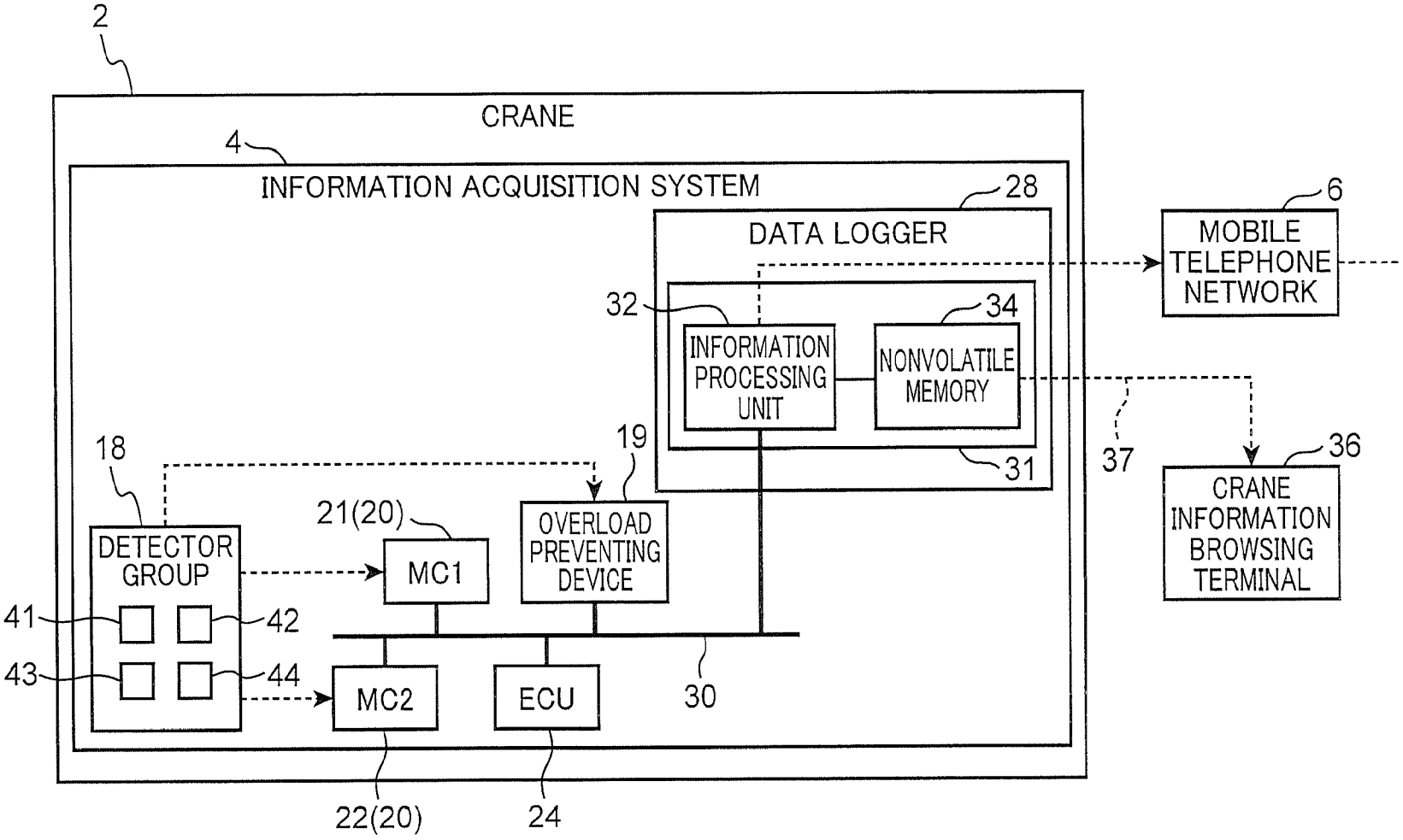
FIG. 7 is a diagram illustrating, in a same manner as in FIG. 3, a configuration of a modification of the present invention.

As illustrated in FIG. 7, a crane information browsing terminal 36 may be connected to the nonvolatile memory 34 of the data logger 28 via a communication line 37, such as a universal serial bus (USB), to copy the lifting rope statistical information and the raising rope statistical information stored in the nonvolatile memory 34 to the crane information browsing terminal 36. For example, a personal computer is used as the crane information browsing terminal 36. The copied statistical information may be analyzed by application software in the crane information browsing terminal 36 to generate data of the cumulative time distribution maps of the lifting rope 66 and the raising rope 67. The distribution map generated in the crane information browsing terminal 36 can be browsed through the crane information browsing terminal 36. The crane information browsing terminal 36 is included in the concept of the presenting unit of the present invention.

Figure 8:
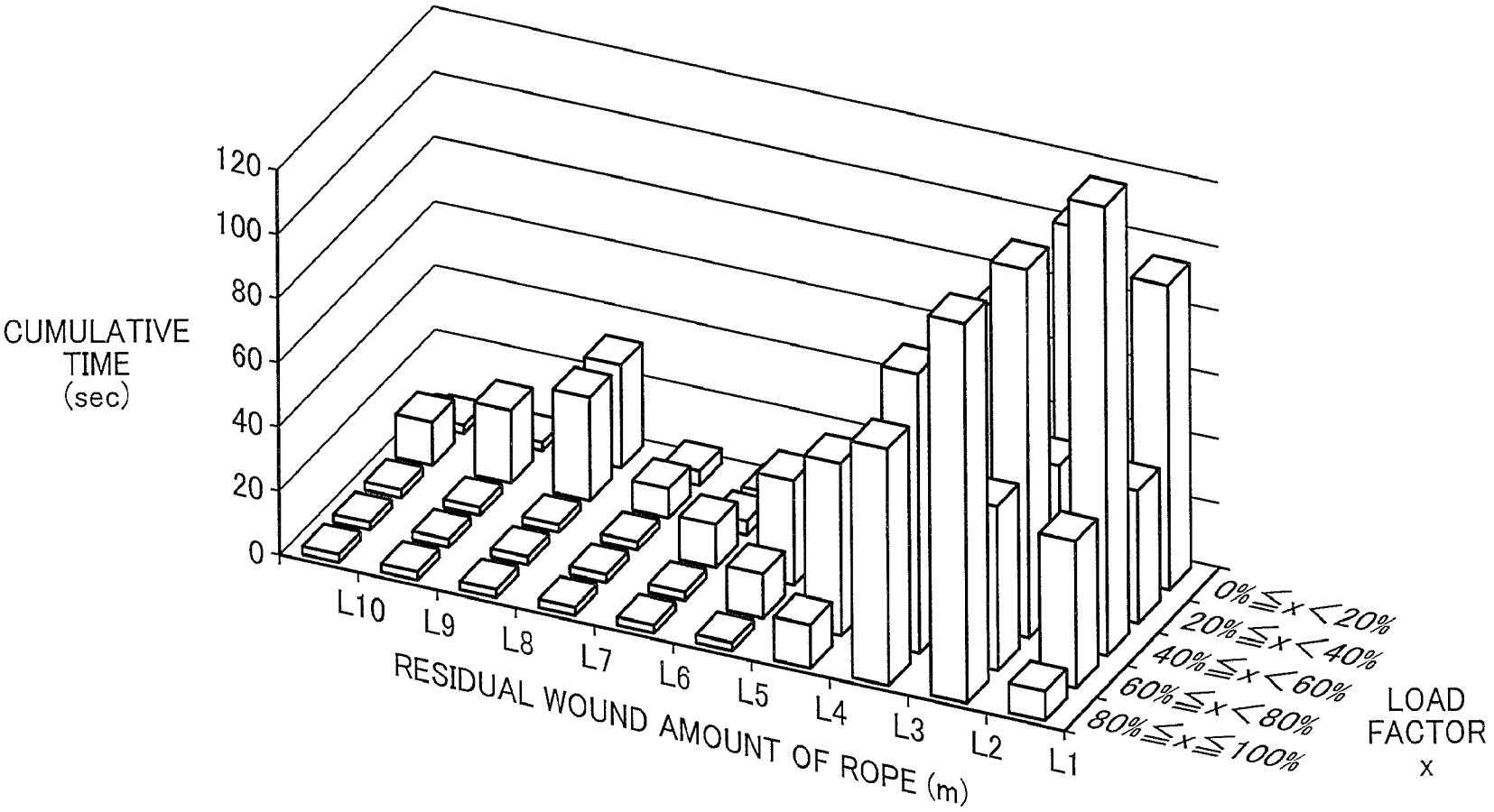
FIG. 8 is a cumulative time distribution map generated from lifting rope statistical information stored in a nonvolatile memory of the data logger.

In this case, there is no need to wait for the time period data of the lifting rope statistical information and the raising rope statistical information to be transmitted to the information accumulation server 10. The distribution maps of the lifting rope 66 and the raising rope 67 generated from the lifting rope statistical information and the raising rope statistical information stored in the nonvolatile memory 34 at the moment (for example, see FIG. 8) can be browsed through the crane information browsing terminal 36.

A storage medium, such as a USB memory, may be used as means for copying the lifting rope statistical information and the raising rope statistical information from the nonvolatile memory 34 to the crane information browsing terminal 36.

The information processing unit 32 of the data logger 28 may transmit, without analyzing, the acquired load factor and residual wound amount data of the lifting rope 66 and the raising rope 67 to the information accumulation server 10 of the presenting unit 9. In this case, the information accumulation server 10 may generate the lifting rope statistical information and the raising rope statistical information based on the data on the received load factors and residual wound amounts of the lifting rope 66 and the raising rope 67, and generate, from the generated statistical information, data of the distribution maps of the cumulative time of the lifting rope 66 and the raising rope 67. In this case, the information accumulation server 10 is included in the concept of the information processing device of the present invention.

In this configuration, the accumulated information browsing terminal 14 may generate data of the distribution map in place of the information accumulation server 10. That is, the lifting rope statistical information and the raising rope statistical information may be downloaded from the information accumulation server 10 to the accumulated information browsing terminal 14, and the downloaded statistical information may be analyzed in the accumulated information browsing terminal 14 using application software to generate data of the distribution maps of the cumulative time of the lifting rope 66 and the raising rope 67.

The communication network used for transmitting data from the data logger 28 (information processing unit 32) to the information accumulation server 10 is not necessarily limited to the mobile telephone network 6. For example, a local area network (LAN) or other communication networks may be used.

Figure 9:
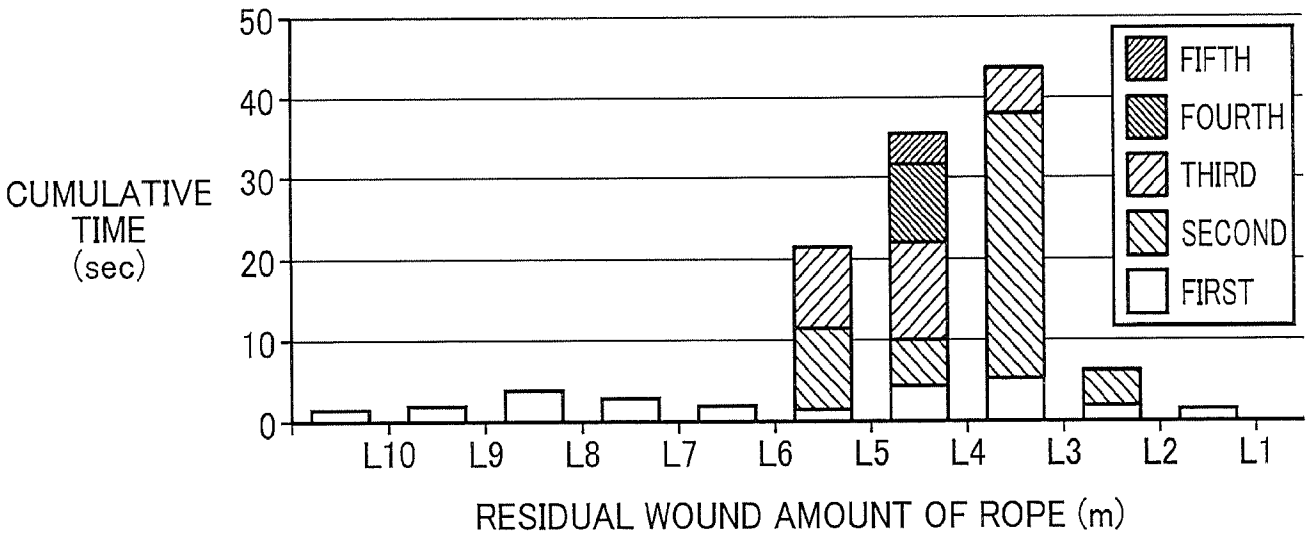
FIG. 9 is an example of a load distribution map illustrating distribution of large load conditions that have occurred.

The information processing unit 32 may generate load information indicating the cumulative time for which a large load condition has occurred for each sections of the wound-out length of the lifting rope 66 (the raising rope 67), store the load information in the nonvolatile memory 34, and transmit the load information together with the lifting rope statistical information and the raising rope statistical information to the information accumulation server 10. The information accumulation server 10 then generates, from the received load information, data of a load distribution map as illustrated in FIG. 9 so that the generated load distribution map can be browsed through the accumulated information browsing terminal 14.

Specifically, in a large load condition, the load factor is 80% or more and 100% or less. The information processing unit 32 extracts the data indicating the relationship between the cumulative time in the load factor section of 80% or more and 100% or less and the residual wound amount of the lifting rope 66 (the raising rope 67) from the lifting rope statistical information (the raising rope statistical information) to generate the load information. The information processing unit 32 counts the number of times the large load conditions have occurred, that is, the number of acquired load factors that are within the range of 80% or more and 100% or less, and counts up the duration time of each large load condition. The information processing unit 32 adds, to the load information, the data on the obtained number of times that the large load conditions have occurred and the duration time of each large load condition. The load information acquired by the information processing unit 32 is stored in the nonvolatile memory 34 of the data logger 28 and transmitted to the information accumulation server 10. The information accumulation server 10 generates data of the load distribution map (see FIG. 9) based on the received load information.

The load distribution map is a bar chart showing the cumulative time for which a large load condition has occurred for each sections of the residual wound amount of the lifting rope 66 (the raising rope 67). The bar representing the cumulative time for each residual wound amount section is composed of sections (identified by colors) representing the number of times of occurrence of large load conditions, where the length in the vertical axis (cumulative time axis) of each section representing the number of times of occurrence indicates the duration time of the large load condition.

By browsing the load distribution map through the accumulated information browsing terminal 14, a viewer can recognize how long the large loads have been applied to the lifting rope 66 and the raising rope 67 and also recognize the number of times the large loads have occurred and the duration time of each large load.

In place of the information accumulation server 10, the information processing unit 32 of the data logger 28 or the accumulated information browsing terminal 14 may generate the data of the load distribution map.

The crane 2 may include an alarm unit that sets an alarm based on the lifting rope statistical information and the raising rope statistical information to promote checking of the lifting rope 66 and the raising rope 67.

For example, the crane 2 may include, as the alarm unit, a displaying monitor for displaying a message to an operator to promote checking of the lifting rope 66 and the raising rope 67. In this case, for example, the information processing unit 32 of the data logger 28 may be configured to add up the cumulative time of the lifting rope statistical information for different work positions of the crane 2, with different lifting capacity, to calculate the used time of the lifting rope 66 and display a message on a display monitor to promote checking of the lifting rope 66 at the timing when the calculated used time exceeds a specified time. Likewise, the information processing unit 32 may be configured to calculate the used time of the raising rope 67 from the raising rope statistical information and display a message on a display monitor to promote checking of the raising rope 67 when the calculated used time exceeds a specified time.

Instead of the display monitor, a buzzer that emits a sound or a lamp that emits light to alert and promote an operator to check the lifting rope 66 and the raising rope 67 may be used as the alarm unit.

The crane 2 may include a measuring device for measuring diameters of the lifting rope 66 and the raising rope 67, and the information processing unit 32 of the data logger 28 may acquire the data on the diameters of the lifting rope 66 and the raising rope 67 measured by the measuring device and accumulate the data in the nonvolatile memory 34. The information processing unit 32 may be configured to transmit the data on the diameters of the lifting rope 66 and the raising rope 67 accumulated in the nonvolatile memory 34 to the presenting unit 9, so that the presenting unit 9 presents the received data on the diameters of the lifting rope 66 and the raising rope 67 together with the lifting rope statistical information and the raising rope statistical information.

In this configuration, the information on the strength of the loads that act on the lifting rope 66 and the raising rope 67 and the residual wound amounts of the lifting rope 66 and the raising rope 67 as well as the information on the temporal change in the diameters of the lifting rope 66 and the raising rope 67 can be presented. As a load applied to the wire rope increases, the wire rope extends and the diameter thereof decreases. If wire breakage occurs by fatigue accumulated in the wire rope, the diameter of the wire rope decreases. Thus, the information on the temporal change in the diameters of the lifting rope 66 and the raising rope 67 provides a guideline for the timing to replace the lifting rope 66 and the raising rope 67. By presenting this information together with the lifting rope statistical information and the raising rope statistical information, information on a guideline for determining the timing to replace the lifting rope 66 and the raising rope 67 with high accuracy can be provided.

Instead of the load factors, actual loads applied to the lifting rope 66 and the raising rope 67 may be used as load indexes of the present invention.

In statistical tables of the lifting rope statistical information and the raising rope statistical information, fatigue of the lifting rope 66 and the raising rope 67 may be weighted for the cumulative time in each cell. Specifically, conditions of the residual wound amount that is likely to cause damage to the lifting rope 66 and the raising rope 67 are derived from the past maintenance information of the lifting rope 66 and the raising rope 67, and based on the derived conditions, the cell belonging to a residual wound amount section which is likely to cause damage may be weighted large and the cell belonging to the section which is relatively unlikely to cause damage may be weighted small. A cell of a section with a larger load factor may be weighted larger.

In the distribution maps of the lifting rope 66 and the raising rope 67, feature amounts indicating the used conditions of the lifting rope 66 and the raising rope 67 during a crane operation may be derived by, for example, deriving the weighted center in the cumulative time distribution and calculating dispersion of the load factor along the axial direction and dispersion of the residual wound amount along the axial direction. For example, the feature amount is derived while a wire rope is used as the lifting rope 66 during a crane operation. After replacing the wire rope with another wire rope which is then used as the lifting rope 66 for a crane operation, the feature amount can be derived in the same manner. If the derived feature amount is the same as the feature amount of the previous wire rope, which has been replaced, it is indicated that the lifting rope 66 is used in the same manner as the previous wire rope. The same is applied to the raising rope 67.

The length of the lifting rope 66 wound out from the hoisting winch 61 can be derived based on the residual wound amount of the lifting rope 66 on the hoisting winch 61. The derived wound-out length can be used as the wound-out length index of the present invention. The length of the raising rope 67 wound out from the raising winch 62 can be derived based on the residual wound amount of the raising rope 67 on the raising winch 62. The derived wound-out length can be used as the wound-out length index of the present invention.

In this case, for example, the data logger 28 may be provided with a wound-out length calculating unit, and the wound-out length calculating unit may calculate the wound-out length of the lifting rope 66 by subtracting the residual wound amount of the lifting rope 66 calculated by the first main controller 21 from the total length of the lifting rope 66 registered in advance. Alternatively, the wound-out length calculating unit may calculate the wound-out length of the raising rope 67 by subtracting the residual wound amount of the raising rope 67 calculated by the second main controller 22 from the total length of the raising rope 67 registered in advance. Instead of providing the data logger 28 with the wound-out length calculating unit, the first main controller 21 may calculate the wound-out length of the lifting rope 66 while the second main controller 22 calculates the wound-out length of the raising rope 67. The calculated wound-out lengths of the lifting rope 66 and the raising rope 67 may be used instead of the residual wound amounts of the lifting rope 66 and the raising rope 67 to generate and present the statistical information, and the distribution data and the distribution map of the cumulative time.

The present embodiment is summarized as follows.

A crane information presentation system according to the present embodiment presents information on a wire rope of a crane including a winch for winding and unwinding the wire rope to lift or lower an object, and the system includes a load index deriving unit that derives at a predetermined cycle a load index which is an index of a load applied to the wire rope, an information processing device that acquires the load index at the predetermined cycle to generate statistical information indicating a relationship between a cumulative time and the load index, the cumulative time being a time for which a load corresponding to the load index has been applied to the wire rope, and a presenting unit that presents the statistical information generated by the information processing device.

In the crane information presentation system, the presenting unit presents the statistical information indicating the relationship between the load index, which is an index of a load applied to the wire rope, and the cumulative time for which the load corresponding to the load index has been applied to the wire rope. Based on the presented statistical information, what level of load has been applied to the wire rope for what length of cumulative time can be recognized. Thus, the information presentation system can present information that provides a guideline for determining the timing to replace the wire rope used for the winch of the crane from a view point of fatigue accumulated in the wire rope.

Preferably, the crane information presentation system further includes a wound-out length index deriving unit that derives at the predetermined cycle a wound-out length index which is an index of a length of the wire rope wound out from the winch, wherein the information processing device acquires at the predetermined cycle the load index and the wound-out length index to generate, as the statistical information, load and wound-out-length statistical information indicating a relationship among the cumulative time, the load index, and the wound-out length index, the cumulative time for which the load corresponding to the load index has been applied to the wire rope wound out by a length corresponding to the wound-out length index, and the presenting unit presents the load and wound-out-length statistical information generated by the information processing device.

With this configuration, the presenting unit presents the load and wound-out-length statistical information indicating the relationship among the load index, the wound-out length index, and the cumulative time. The load and wound-out-length statistical information presented by the presenting unit indicates what level of load has been applied to the wire rope for what length of cumulative time with what length of the wire rope wound out from the winch.

In this case, the information processing device preferably classifies the load index and the wound-out length index each into a plurality of sections, calculates the cumulative time for each sections, and generates, as the load and wound-out-length statistical information, cumulative time distribution data indicating distribution of respective cumulative times of the sections.

With this configuration, the cumulative time distribution data indicating distribution of the cumulative time among the categories of the load index and the wound-out length index can be obtained, and the presenting unit can present the cumulative time distribution data. That is, the cumulative time distribution data can be presented which indicates that the cumulative time has greatly accumulated for what level of load applied to the wire rope with what length of the wire rope wound out from the winch.

Furthermore, in this case, the presenting unit preferably includes a display unit that displays distribution of the cumulative times of the sections indicated by the cumulative time distribution data generated by the information processing device.

With this configuration, the display unit displays the cumulative time distribution among the categories of the load index and the wound-out length index, so that correlation among the level of load applied to the wire rope, the wound-out length of the wire rope, and the cumulative time can visually be recognized at a glance.

The wound-out length index deriving unit preferably derives, as the wound-out length index, a residual wound amount which is a length of the wire rope still wound around the winch.

With this configuration, a portion of the wire rope on which a load is applied can be specified in a realistic and practical manner without using any additional measuring device, and the load and wound-out-length statistical information that are not affected by the position of the crane or the like can be presented. Specifically, directly detecting a portion of the wire rope on which a load is applied is difficult during a crane operation, whereas the amount of the wire rope wound around the winch is usually measured by some kinds of method and the total length of the wire rope is a known value. Therefore, the length of the portion of the wire rope wound out from the winch can be obtained from the residual wound amount of the wire rope on the winch. Although a very local portion of the wire rope on which a load is applied cannot be recognized, it is possible to roughly recognize which portion of the entire wire rope a load is applied on, based on the residual wound amount value. This configuration derives the residual wound amount of the wire rope on the winch as a wound-out length index and thereby specifies, in a realistic and practical manner without using any additional measuring device, the portion of the wire rope on which a load is applied. Since the residual wound amount of the wire rope on the winch is not affected by the position of the crane or the like, this configuration derives the residual wound amounts as the wound-out length index to present the load and wound-out-length statistical information that is not affected by the position of the crane or the like.

The invention claimed is:

1. A crane information presentation system that presents information on a wire rope of a crane including a winch for winding and unwinding the wire rope to lift and lower an object, the system comprising:

a load sensor that detects a load applied to the wire rope;

a load index deriving unit that derives, based on the load detected by the load sensor at a predetermined cycle, a load index which is an index of the load;

an information processing device that acquires the load index at the predetermined cycle to generate statistical information indicating a relationship between a cumulative time and the load index, the cumulative time being a time for which a load corresponding to the load index has been applied to the wire rope;

a presenting unit that presents the statistical information generated by the information processing device; and a wound-out length index deriving unit that derives at the predetermined cycle a wound-out length index which is an index of a length of the wire rope wound out from the winch, wherein the information processing device acquires at the predetermined cycle the load index and the wound-out length index to generate, as the statistical information, load and wound-out-length statistical information indicating a relationship among the cumulative time, the load index, and the wound-out length index, the cumulative time for which the load corresponding to the load index has been applied to the wire rope wound out by a length corresponding to the wound-out length index, and wherein the presenting unit presents the load and wound-out-length statistical information generated by the information processing device.

2. The crane information presentation system according to claim 1, wherein the information processing device classifies the load index and the wound-out length index each into a plurality of sections, calculates the cumulative time for each sections, and generates, as the load and wound-out-length statistical information, cumulative time distribution data indicating distribution of respective cumulative times of the sections.

3. The crane information presentation system according to claim 2, wherein the presenting unit includes a display unit that displays distribution of the cumulative times of the sections indicated by the cumulative time distribution data generated by the information processing device.

4. The crane information presentation system according to claim 1, wherein the wound-out length index deriving unit derives, as the wound-out length index, a residual wound amount which is a length of the wire rope wound around the winch.

5. The crane information presentation system according to claim 1, further comprising a rotation amount sensor that detects a rotation amount of a drum around which the wire rope is wound, wherein the wound-out length index deriving unit derives the wound-out length index, at the predetermined cycle, based on the rotation amount detected by the rotation amount sensor.

6. The crane information presentation system according to claim 2, wherein the wound-out length index deriving unit derives, as the wound-out length index, a residual wound amount which is a length of the wire rope wound around the winch.

7. The crane information presentation system according to claim 3, wherein the wound-out length index deriving unit derives, as the wound-out length index, a residual wound amount which is a length of the wire rope wound around the winch.

* * * * *